US008226452B2

(12) United States Patent
Hendrickson

(10) Patent No.: US 8,226,452 B2
(45) **Date of Patent: *Jul. 24, 2012**

(54) PULL UP NURSING UNDERGARMENT

(75) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 636 days.

This patent is subject to a terminal disclaimer.

(21) Appl. No.: 12/497,901

(22) Filed: Jul. 6, 2009

(65) Prior Publication Data

US 2010/0068972 A1 Mar. 18, 2010

Related U.S. Application Data

(63) Continuation-in-part of application No. 12/108,960, filed on Apr. 24, 2008, now Pat. No. 7,878,881.

(51) Int. Cl.
*A41C 3/00* (2006.01)

(52) U.S. Cl. ..... 450/30; 2/104

(58) Field of Classification Search ..... 450/30–32, 450/53, 55–57, 36, 37, 10–13, 15, 16, 18, 450/20, 23; 2/73, 113–115, 104–106, 247
See application file for complete search history.

(56) References Cited

U.S. PATENT DOCUMENTS

| | | | | |
|---|---|---|---|---|
| 4,355,641 | A | 10/1982 | Dastoli et al. | |
| 4,494,388 | A * | 1/1985 | Lau et al. | 66/178 A |
| 5,149,336 | A * | 9/1992 | Clarke et al. | 604/388 |
| 5,461,725 | A | 10/1995 | Witczak | |
| 5,611,086 | A * | 3/1997 | Eggen | 2/104 |
| 5,652,049 | A * | 7/1997 | Suzuki | 442/387 |
| 6,276,175 | B1 | 8/2001 | Browder, Jr. | |
| 6,374,643 | B2 * | 4/2002 | Orima | 66/193 |
| 6,723,428 | B1 * | 4/2004 | Foss et al. | 428/370 |
| 6,839,908 | B2 * | 1/2005 | Schneider et al. | 2/73 |
| 6,854,132 | B1 * | 2/2005 | Polzin | 2/104 |
| 6,855,029 | B2 * | 2/2005 | Rothman | 450/36 |
| 6,983,489 | B2 * | 1/2006 | Caprio | 2/69 |
| 7,076,809 | B2 | 7/2006 | Rothman | |
| 7,077,720 | B2 * | 7/2006 | Schneider et al. | 450/36 |
| 7,192,409 | B2 | 3/2007 | Lorenzo | |
| 7,396,272 | B1 * | 7/2008 | Newlen | 450/54 |
| 7,430,883 | B2 * | 10/2008 | Sorensen | 66/176 |
| 7,448,090 | B2 * | 11/2008 | Lucock | 2/104 |
| 7,546,751 | B2 * | 6/2009 | Lutz | 66/177 |
| 7,878,881 | B2 * | 2/2011 | Hendrickson | 450/36 |
| 2006/0277948 | A1 * | 12/2006 | Sorensen | 66/1 R |

FOREIGN PATENT DOCUMENTS

DE 200 14 080 U1 12/2000

* cited by examiner

*Primary Examiner* — Gloria Hale

(74) *Attorney, Agent, or Firm* — DLA Piper LLP (US)

(57) ABSTRACT

A nursing undergarment is constructed with an outer bodice and an inner bodice, wherein the outer bodice is adapted for pulling up to uncover the inner bodice. The inner bodice has breast-feeding openings located for nursing and infant while wearing the inner bodice. The outer bodice provides breast cups. The outer bodice provides a bra-like support. The inner bodice is stretchable and provides a bra-like support.

16 Claims, 10 Drawing Sheets

PULL UP NURSING UNDERGARMENT

CROSS REFERENCE TO RELATED APPLICATION

The present application is a Continuation-In-Part of U.S. patent application Ser. No. 12/108,960, filed Apr. 24, 2008 now U.S. Pat. No. 7,878,881.

FIELD OF THE INVENTION

The present invention relates to a nursing undergarment, and more particularly to a nursing undergarment having a pull up bodice adapted for nursing an infant.

BACKGROUND

U.S. Pat. No. 6,854,132 discloses a nursing undergarment, including an outer garment and an inner garment. The inner garment includes two chest panels that overlap with one another in crisscross fashion. A nursing mother may raise the outer garment over her chest and pull either chest panel below her breast for breast-feeding an infant.

U.S. Pat. No. 5,461,725 discloses a garment featuring stretchable, resilient straps and a bodice. The straps and bodice are resilient and stretchable. The bodice has a resilient, stretchable bottom and a resilient, stretchable shining on the front of the bust. The shoulder straps stretch when the bodice is pulled down to nurse an infant. The front shirring and the stretchable bottom cooperatively form a cup conforming to a breast of a wearer of the garment. A removable breast pad is attached on the inner surface of a cup using snap fasteners.

U.S. Pat. No. 6,983,489 discloses a nursing garment having breast retention panels constructed with two layers of fabric. An inner layer contains openings to insert breast cups. An outer layer provides an outer covering. The two layers are sewn together to form a pocket with an opening on the body side to provide access for receiving a pad.

U.S. Pat. No. 7,076,809 discloses a nursing garment having internal and external, nursing flaps attached by respect respective fasteners to a shoulder strap. A built-in nursing bra is provided by internal sections comprising an elastic chest band, a soft cup frame, the internal nursing flaps, and a back piece of fabric. The internal fabric and flap can also have a pocket made of netting or made of fabric material to hold a nursing pad in place. The fasteners may include snaps, clasps or a hook and loop type fastener, in order to hold the internal and external fabric flaps, which cover the breasts and the soft cup frame.

U.S. Pat. No. 5,149,336 discloses disposable breast cups for a nursing and maternity bra. The breast cups comprise three layers; an inner fluid wicking layer, a central fluid layer and an outer moisture resistant layer.

SUMMARY OF THE INVENTION

A nursing undergarment has an inner bodice having breast-feeding openings located for breast-feeding an infant. An outer bodice of the undergarment is adapted for pulling up to uncover the inner bodice in preparation for breast-feeding, and is adapted for pulling down to cover the inner bodice.

In preparation for nursing an infant, the outer bodice is pulled up to uncover the inner bodice and the breast feeding openings. After nursing is completed, the outer bodice is adapted for pulling down to cover the inner bodice.

An embodiment of the nursing undergarment is in the form of a nursing bra.

An embodiment of the nursing undergarment is seamless and has adjustable straps without fasteners that would require connection and disconnection. Another embodiment is fabricated of cut and sew knitted or woven pieces of fabric.

BRIEF DESCRIPTION OF THE DRAWINGS

Embodiments of the invention will now be described by way of example with reference to the accompanying drawings.

DETAILED DESCRIPTION

Figure 1:
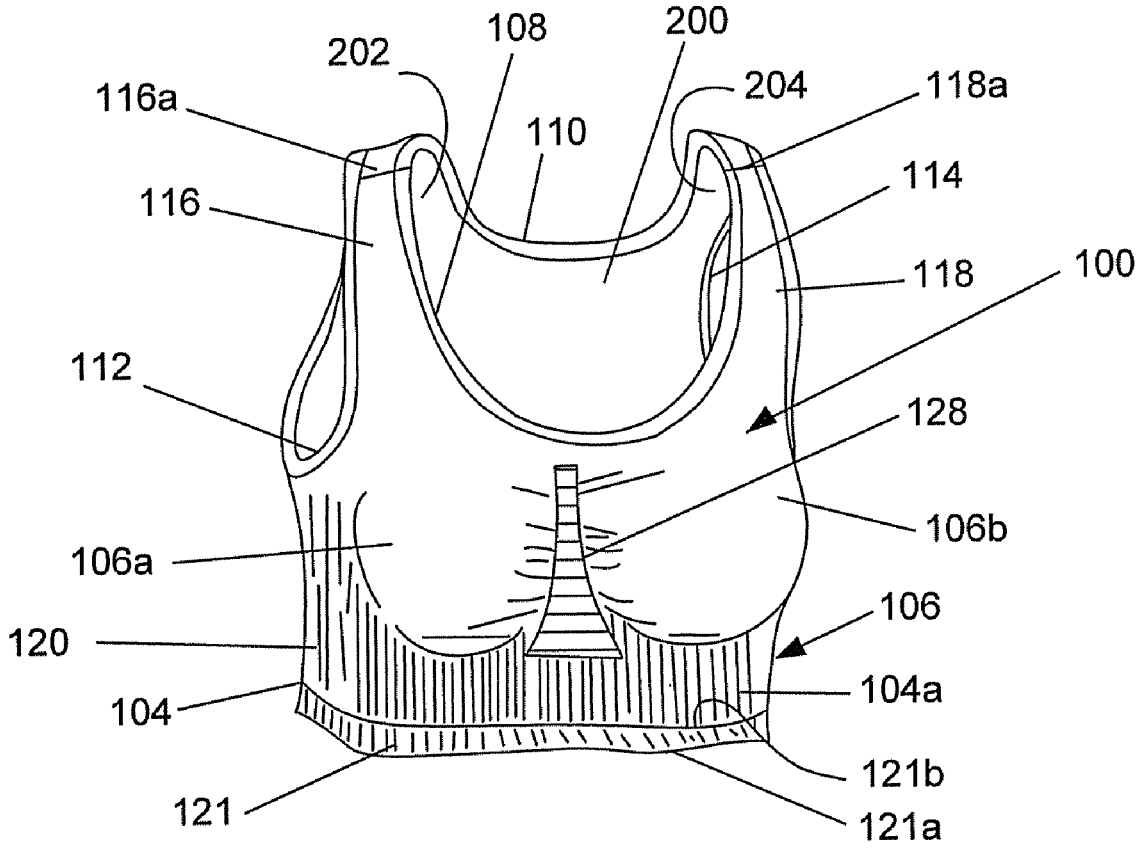
FIG. 1 is an isometric view of a nursing undergarment having an outer bodice and an inner bodice covered by the outer bodice.
Figure 4:
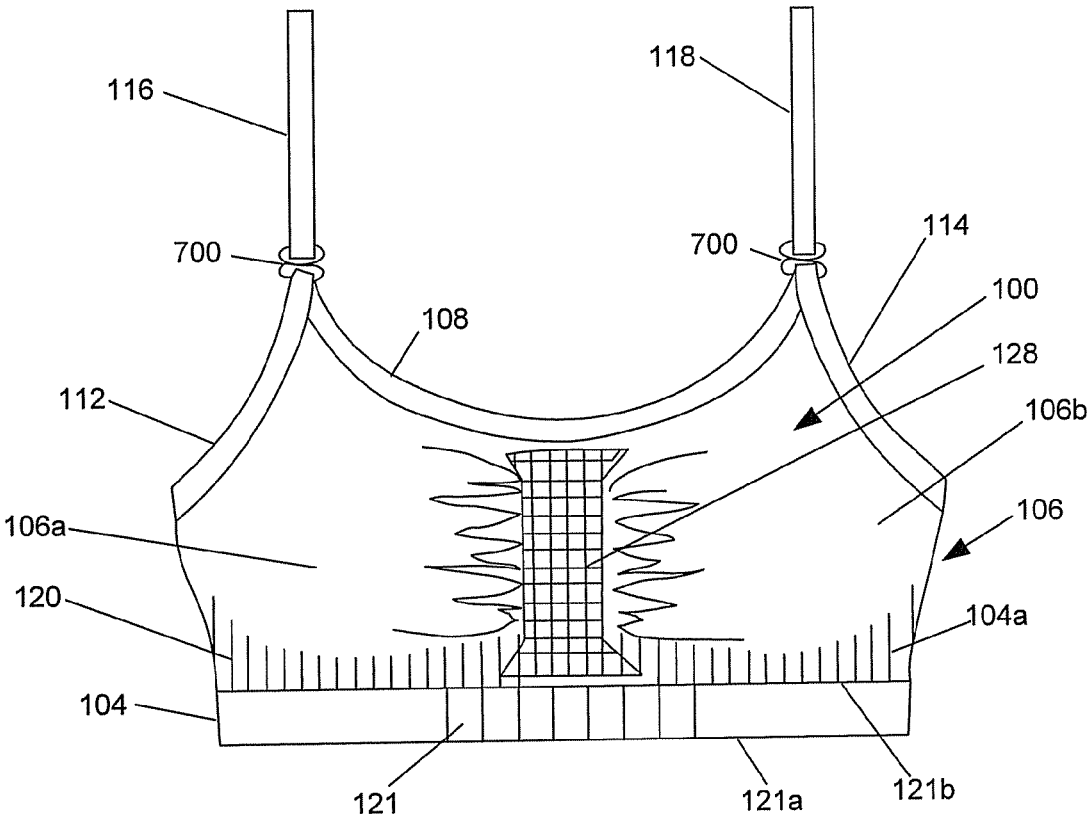
FIG. 4 is an elevation view of an alternative construction of a nursing undergarment.

FIG. 1 discloses a nursing undergarment 100 for nursing or breast-feeding an infant. FIG. 4 discloses an alternative construction of the nursing undergarment 100. The construction of the nursing undergarment 100 is constructed for breast-feeding a nursing infant and can be worn layered under an outer garment including, but not limited to a shirt or blouse, sweater or jacket. Embodiments of the nursing undergarment 100 provide a non-revealing, smooth outer appearance. According to an embodiment of the invention, the nursing undergarment 100 provides a nursing bra to support a wearer's breasts and an outer bodice to cover the nursing bra and further to support a wearer's breasts.

The invention fulfills a need for a nursing undergarment that is functional in terms of securing the bust area and having a nursing function, while providing an outer bodice for modesty and breast support and an attractive appearance. Further, the invention provides a nursing undergarment having soft breast cups as part of the bust area construction.

As disclosed by FIGS. 1 and 4, each embodiment of the nursing undergarment 100 provides an outer bodice 106 to be worn under an outer layer of clothing including, but not limited to a shirt, sweater or jacket. The outer bodice 106 is adapted to be pulled up in preparation for nursing without requiring removal of the outer layer of clothing.

The outer bodice 106 is fashioned as a knitted undergarment bodice. The outer bodice 106 is a resiliently stretchable and contractible fabric, and is knitted with spandex or elastane fibers, such as LYCRA® fibers. The outer bodice 106 is seamless and tubular, and is circular knitted in one piece. The outer bodice 106 is knitted with a smooth appearance covering the breasts of the wearer. The fibers of smooth cup portions 106*a*, 106*b* of the outer bodice 106 stretch about the breasts of the wearer with a moderate amount of resilient recovery.

The outer bodice 106 has a center front stitch 128 in the form of a knitted, center front elastic band, which is stretchable and contractible, and which forms a fashion front for a fashionable appearance. In FIG. 1, the elastic band 128 is knitted with spandex or elastane fibers. The center front elastic band 128 is knitted with a vertical rib stitch on a front side of the fabric, and is knitted with a horizontal rib stitch on a back side of the fabric, such that the knitted ribs on front and back sides, respectively, are orthogonal to one another and provide a stiffly stretchable and resilient bra-like support. The center front elastic band 128 extends lengthwise vertically from near the front neckline 108 to near the chest band 104 and attaches with stitches the outer bodice 106 to a stretchable inner panel 122, as disclosed by FIGS. 1A and 1B, which partitions the stretchable inner panel 122 into cup receiving pockets 130, 132 that retain the breast cups 124, 126, and prevent the cups from shifting positions, especially while the garment is worn. The knitted, center front elastic band 128 is relatively narrow and extends vertically between the breast cups 124, 126 such that the center front elastic band 128 extends vertically between the breasts of a wearer. An embodiment of the elastic band 128 widens laterally at the bottom thereof to provide widened lateral support below and between the wearer's breasts. Further, the center front elastic band 128 restricts undesired lateral shifting of the outer bodice 106 when worn.

Figure 2:
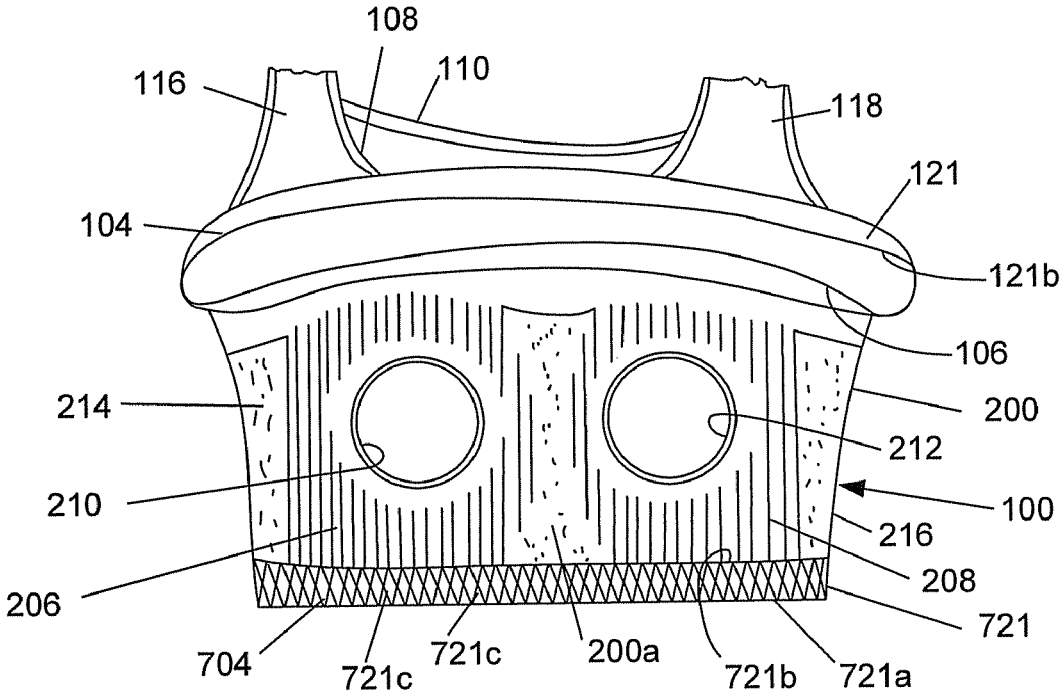
FIG. 2 is an elevation view of the nursing undergarment of FIG. 1 with an outer bodice pulled up to uncover an inner bodice in preparation for nursing.

The outer bodice 106 provides an outer bra to support the wearer's breasts. The stretchable portion 122 of the outer bodice 106, the center front stitch 128 and a stretchable elastic chest band 104 each contribute to a bra-like support of the wearer's breasts. Further, a stretchable elastic inner bodice 200, FIG. 2, provides an inner bra to support the wearer's breasts.

In FIGS. 1 and 4, each embodiment of the chest band 104 has a circular knitted, rib stitched, torso encircling portion 104*a*. The chest band with the torso encircling portion 104*a* laterally encircles the garment to encircle a torso of a wearer of the garment 100, and extends laterally across the front of the outer bodice 106 and under the breasts of the wearer to provide a bra-like support. The torso encircling portion 104*a* is knitted with spandex or elastane fibers knitted into vertical ribs 104*a*, which can stretch resiliently and contract. A knitted vertical rib stitch on the front side of the fabric has its ribs alternating side-to-side with vertical ribs of a vertical rib stitch on the back side of the fabric. The ribs are thin or slender, fine ribs. The fabric stretches and contracts resiliently in two orthogonal directions to exert a force of resilient recovery from stretching, and to provide a desirable bra-like support.

Further, in each embodiment shown in FIGS. 1 and 4, the outer bodice 106 is open along the bottom just below the chest band 104. The bottom hem 121 of the chest band 104 is knitted with extra spandex or elastane fibers, such as LYCRA® fibers in a diagonal rib stitch overlying the fine ribbed knit of the torso encircling portion 120. The extra spandex or elastane fibers provides elastic support under the wearer's breasts to serve as a bra support. In FIGS. 1 and 4, the bottom hem 121 is knitted with a turn back fold 121*a*, such that the bottom hem is turned back to extend inside the outer bodice 106. An edge of the turned back, bottom hem 121 is knitted with an anchoring edge stitch 121*b* to join the edge of the bottom hem 121 to the inside of the outer bodice 106. The bottom hem 121 stretches to enlarge its circumference for a wearer to put-on or remove the garment 100.

Further in the embodiment of FIG. 1, the top of the outer bodice 106 has a front neckline 108 and a back neckline 110 and underarm sections 112 and 114 defining arm holes of the garment, which are edge trimmed with a facing reinforcement or binding, for example, a rolled-edge fabric reinforcement that reinforces an edge of the garment fabric, while being comfortable to the touch against a wearer's skin. The back neckline 110 can project close to the neck of a wearer, or can project downward to provide a substantially backless appearance. The front neckline 108 and the back neckline 110 are attached to spaced apart shoulder straps 116, 118 for extending over respective shoulders of a wearer, to hold the garment 100 in place over the chest. The shoulder straps 116, 118 are sufficiently long for ease in removal from the shoulders of a wearer. Opposite ends of the shoulder strap 116 are knitted unitary with the front neckline 108 and the back neckline 110, respectively. The opposite ends of the shoulder strap 116 extend upward from respective necklines 108, 110 to join along a seam 116*a*. Similarly, opposite ends of the shoulder strap 118 are knitted unitary with the front neckline 110 and the back neckline 112, respectively. The opposite ends of the shoulder strap 118 extend upward from the necklines 110, 112 to join along a seam 118*a*. In FIG. 1, the shoulder straps 116, 118 include fabric trimmed in the facing reinforcement or binding, to provide a tank top undergarment to be worn beneath clothing and outerwear. In the event that the undergarment becomes revealed when worn, the tank top is less obvious that it is an undergarment.

Further in the embodiment of FIG. 1, for a tank top, the fabric of the outer bodice 106 extends along the shoulder straps 116, 118. The fabric of each of the shoulder straps 116, 118 is edge trimmed with a facing reinforcement, for example, a rolled-edge fabric reinforcement that reinforces an edge of the garment fabric while being comfortable to the touch against a wearer's skin. The facing reinforcement can extend continuously along an edge of the shoulder strap 116 and a corresponding edge of an underarm section 112 below an arm hole of the outer bodice 106. Similarly, the facing reinforcement can extend continuously along an edge of the shoulder strap 118 and a corresponding edge of an underarm section 114. In FIG. 1, the outer bodice 106 can be tubular and seamless, and can be a circular knit without side seams at corresponding underarm sections 112, 114.

Figure 1A:
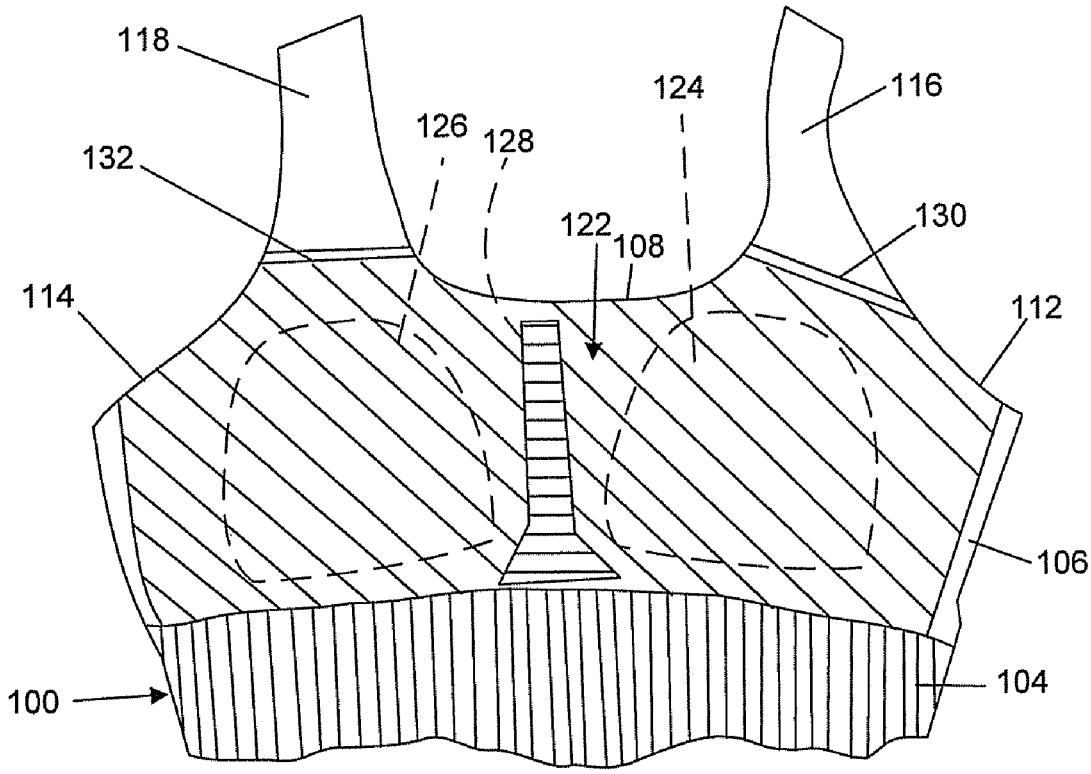
FIG. 1A is a fragmentary elevation view of an inner side or inside of the outer bodice of FIG. 1.
Figure 6:
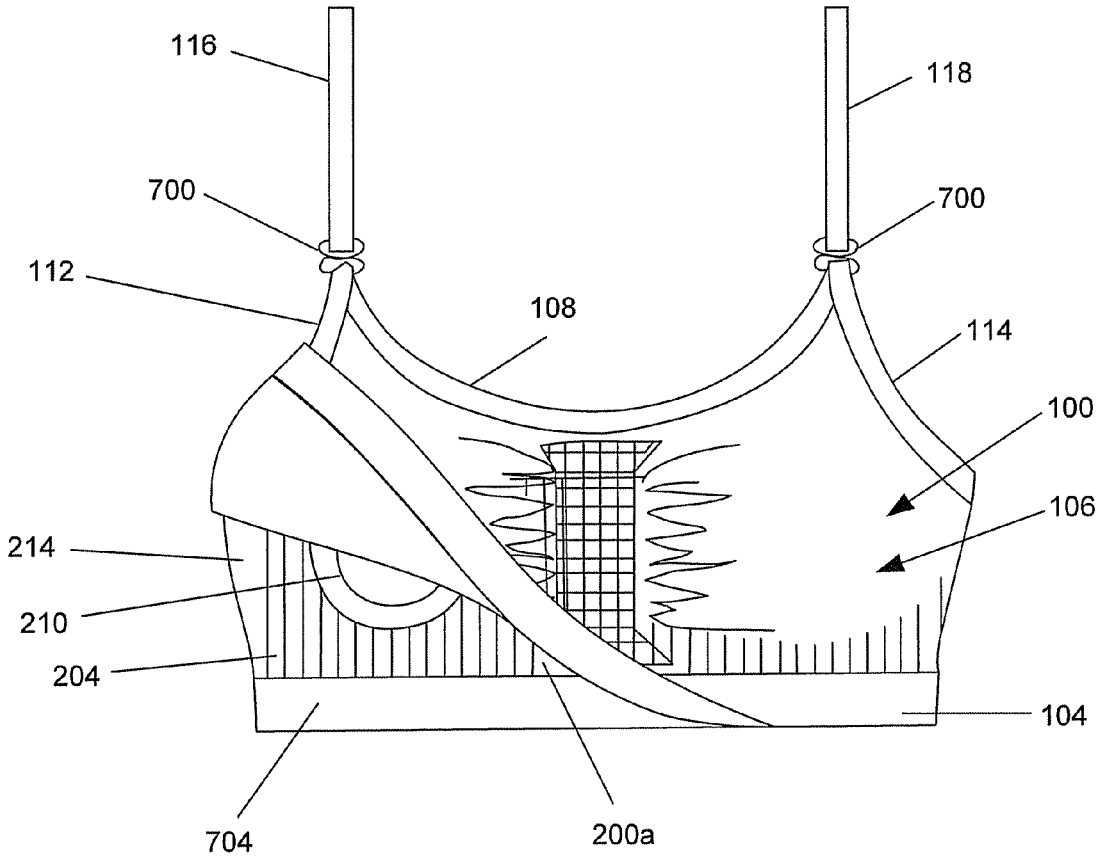
FIG. 6 is an elevation view of the nursing undergarment of FIG. 4, further disclosing an inner bodice uncovered by pulling up the outer bodice of FIG. 4.
Figure 7:
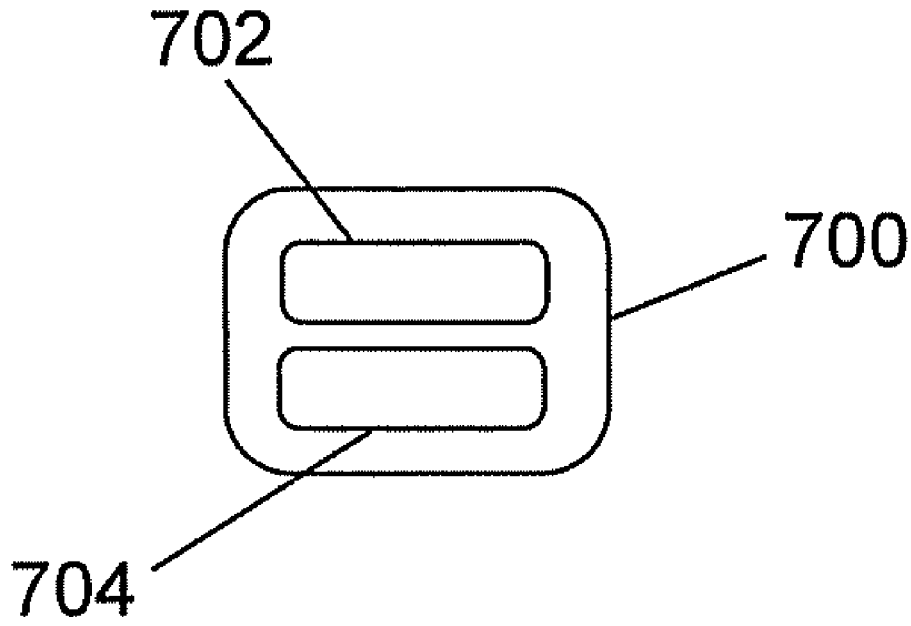
FIG. 7 is an elevation view of an eye fastener.
Figure 8:
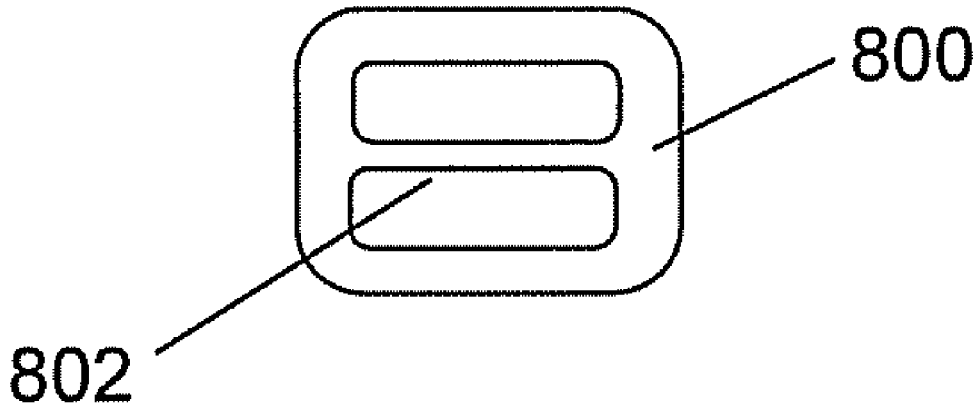
FIG. 8 is an elevation view of a slide-buckle fastener.

FIG. 1A discloses the inside of the outer bodice 106 before being sewn to the embodiments of the inner bodice 200 disclosed in FIGS. 2 and 6, which faces toward the wearer of the garment 100. An stretchable inner panel 122 or lining of the outer bodice 106 is indicated by diagonal lines. The stretchable inner panel 122 or lining is cut and sewn to extend vertically from the front neckline 108 to the chest band 104, and to extend laterally or horizontally across a torso of the wearer of the garment 100. The stretchable inner panel 122 or lining is constructed of a stretchable fabric, knitted or woven. The stretchable fabric includes spandex or elastane fibers, such as LYCRA® fibers. The fabric of the stretchable inner panel 122 is stretchable to undergo elastically in two orthogonal directions, and is moderately stretched elastically while being worn to support the wearer's breasts.

Further in FIG. 1A, a pair of soft padded breast cups 124, 126 are between the outer bodice 106 and the stretchable inner panel 122 or lining. The stretchable inner panel 122 is sewn to the outer bodice 106 with the interior side of a center front stitch 128 extending vertically from near the front neckline 108 to near the chest band 104, which partitions the stretchable inner panel 122 into cup receiving pockets 130, 132 that retain the cups 124, 126 and prevent the cups from shifting positions, especially while the garment is worn. The cups 124, 126 are soft to the touch and are conformable against a wearer's anatomy to provide comfort while worn. The cups 124, 126 are retained in place, and within corresponding pockets 130, 132 without fasteners, which provide a smooth and modest appearance by conforming the fabric of the garment 100 to the smooth exterior contours of the breast cups 124, 126, in the absence of fasteners that would disrupt the contour.

Further in FIG. 1A, the open tops of the pockets 130, 132 are closed by being sewn shut, such that the breast cups 124, 126 are not removable. In an alternative embodiment of FIG. 1B, the pockets 130, 132 have open tops 130*a*, 132*a*. The edges of the pockets 130, 132 are edge trimmed with a facing reinforcement, for example, a marrow stitch edge or rolled-edge fabric reinforcement that reinforces an edge of the garment fabric while being comfortable to the touch against a wearer's skin. Each of the breast cups 124, 126 is retained in a corresponding pocket 130, 132 without being sewn. Each of the breast cups 124, 126 is removable from the corresponding pocket 130, 132 for separate laundering of the breast cups 124, 126 and the garment 100, and for replacement with other breast cups 124, 126. The breast cups 124, 126 are resiliently compacted to facilitate passage through the constricted open tops 130*a*, 132*a*. The pads resiliently expand within the pockets 130, 132. Alternatively, the open tops 130*a*, 132*a* can be sewn shut to retain the breast cups 124, 126 in the pockets 130, 132.

The breast cups 124, 126 cover the wearer's breasts to cover the anatomy and provide a non-revealing smooth profile covered by a smooth portion of the outer bodice 106 extending over the smooth profiles of the breast cups 124, 126. In addition to providing a smooth and modest appearance, the breast cups 124, 126 are advantageously constructed of moisture absorbing material, and/or soft padding material. Further, each of the breast cups 124, 126 has a shaped interior contour to provide support for the breast, and to cover the breast for absorbency and modesty. Each of the breast cups 124, 126 has a shaped exterior contour providing a smooth and attractive outer appearance when covered by the outer bodice 106.

The breast cups 124, 126 are drawn against the wearer's breasts by the elastic resiliency of the torso encircling portion of the outer bodice 106 to augment the bra-like support provided by the outer bodice 106, the chest band 104 and the knitted center front stitch 128.

A structural composition of the cups 124, 126 includes, but is not limited to natural fibers, feathers, down, polymeric fibers, polymeric foam or a combination thereof. Alternatively, an anti-bacterial composition is incorporated in the structural composition or is provided as an additive on the structural composition. Further, the cups 124, 126 are absorbent of fluid matter and are washable in detergent.

In the embodiment of FIG. 1, the outer bodice 106 covers an inner bodice 200, which is in contrast to FIG. 2, wherein the outer bodice 106 is disclosed as being pulled up to uncover the inner bodice 200. The inner bodice 200 is knitted with shoulder straps 202, 204. Opposite ends of the shoulder strap 202 are knitted unitary with an inner layer of fabric having the front neckline 108 and the back neckline 110, respectively. The opposite ends of the shoulder strap 202 extend upward from respective necklines 108, 110 to join along the seam 116*a*. Similarly, opposite ends of the shoulder strap 204 are knitted unitary with an inner layer of fabric having the front neckline 108 and the back neckline 110, respectively. The opposite ends of the shoulder strap 204 extend upward from the necklines 108, 110 to join along the seam 118*a*.

Further in the embodiment of FIG. 1, the inner bodice 200 and the outer bodice 106 are joined by being sewn together at and along the top necklines 110, 112 and under the arms. The shoulder straps 202, 204 of the inner bodice 200 are sewn as linings under the shoulder straps 116, 118 of the outer bodice 106. The shoulder straps 202, 204 and the shoulder straps 116, 118 are for extending over respective shoulders of a wearer, to hold the inner bodice 200 and outer bodice 106 in place over the chest.

In the embodiments of FIGS. 2 and 6, the inner bodice 200 and the bottom portion 102 are seamless and tubular and are circular knitted in one piece to have respective circumferences that completely encircle the garment 100 and the torso of the wearer. The fabric is knitted of a two-way stretchable material, stretchable in two orthogonal directions, suitably soft to the touch and flexible to drape about a wearer's body.

Each of FIGS. 2 and 6 discloses a chest band 704 that can be added to the inner bodice 200, either as a separate cut and sew piece, or by gathering the fabric to form a casing encircling the inner bodice 200 at a desired location of the chest band 704, and encasing a reinforcing elastic band in a manner as described below.

Further in the embodiments of FIGS. 2 and 6, the inner bodice 200 has spaced apart, breast-feeding openings 210, 212 each knitted with, for example, a marrow stitch edge. The openings 210, 212 extend through the inner bodice 200, and are located to expose respective portions of the wearer's breasts for nursing an infant through the inner bodice 200 while wearing the inner bodice 200. Alternatively, in FIG. 2 the inner bodice 200 provides breast supporting sections 206, 208 encircling respective openings 210, 212. The breast supporting sections 206, 208 are separated by a center front section 200*a* of the inner bodice 200 to provide individual breast support. The breast supporting sections 206, 208 are knitted with spandex or elastane fibers knitted into vertical ribs. The ribs are thin or slender, fine ribs. The fabric stretches and contracts resiliently in two orthogonal directions to provide a wearer with desirable bra support for engaging and supporting a wearer's breasts.

The fabric of the inner bodice 200 in the embodiments of FIGS. 2 and 6 is knitted with fine ribbed, torso engaging sections 214, 216 adjacent to the breast supporting sections 206, 208. The torso engaging sections are stretchable resiliently, and contract resiliently, in two orthogonal directions against a wearer's torso, and engage the torso under the arms of the wearer and provide a wearer with bra support. Alternatively, the inner bodice 200 in FIG. 2 can be made as a plain stitch knit, or made as cut and sew pieces with side seams. The stretchable elastic inner bodice 200 in FIG. 2, the stretchable elastic outer bodice 106 in FIGS. 1, 1A and 1B, and the center front elastic band of the center front stitch 128 in FIGS. 1, 1A and 1B, together provide a bra-like support of the wearer's breasts. Thus, the garment 100 is adapted for wearing as a bra providing a wearer with bra support.

Figure 1B:
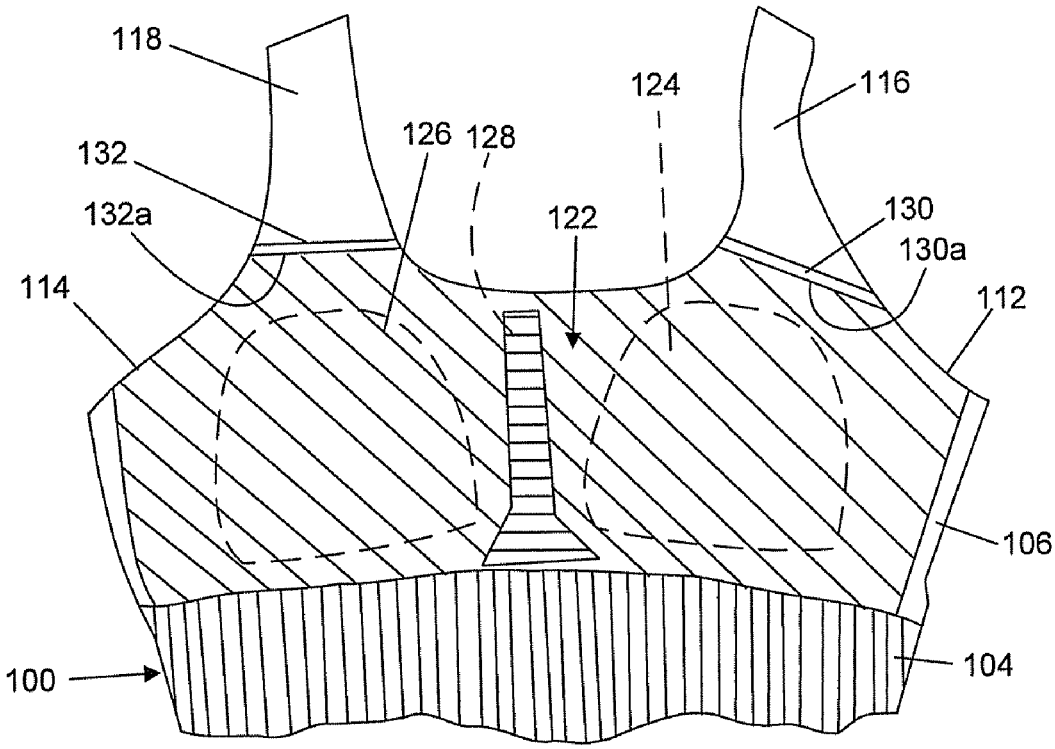
FIG. 1B is a view similar to FIG. 1A disclosing an alternative construction of the inner side or inside of the outer bodice.

In the embodiments of FIGS. 2 and 6, the breast-feeding openings 210, 212 are located to expose respective portions of the wearer's breasts for nursing an infant while wearing the inner bodice 200. FIG. 2 discloses that the shoulder straps 116, 118 of the outer bodice 106 can remain on corresponding shoulders of the wearer, while the outer bodice 106 is pulled up to uncover the openings 210, 212 for nursing an infant through the inner bodice 200. The breast cups 124, 126 disclosed in FIGS. 1A and 1B are resiliently deformable to minimize resistance to being pulled up with the outer bodice 106. Advantageously, the outer bodice 106 can be worn under an outer garment top including, but not limited to a blouse, sweater or jacket that can pulled up with the outer bodice 106. Thus, the outer garment top can be worn while the outer bodice 106 is pulled up in preparation for nursing an infant. The garment 100 avoids a need for removal of the outer garment top or removal of the outer bodice 106 in preparation for nursing an infant.

Further in the embodiments of FIGS. 2 and 6, the entire outer bodice 106 can be pulled up in preparation for nursing an infant, or alternatively, one side of the outer bodice 106 can be pulled up to uncover a wearer's breast on one side in preparation for nursing. In preparation for nursing, to breast-feed an infant held in one of the arms of a wearer, the wearer reaches her hand of the other arm to pull up one side of the outer bodice 106 to uncover a portion of the inner bodice 200 and to uncover one of the wearer's breasts for nursing the infant at the breast on one side. During nursing, the inner bodice 200 is held up by the shoulder straps 202, 204 that are further disclosed in FIGS. 1 and 4, respectively. The inner bodice 200 is held down by the bottom garment portion 102. After nursing on the one side is completed, the outer bodice 106 is pulled down to cover the inner bodice 200 and provide support for the wearer's breasts.

The fabric of the inner bodice 200 can be made of a plain stitch knit or can be made of cut and sew pieces sewn with side seams of previously disclosed embodiments of the invention. Alternatively, in FIG. 2 the inner bodice 200 is knitted with fine ribbed, torso engaging sections 214, 216 adjacent to the breast supporting sections 206, 208. The torso engaging sections 214, 216 stretch and contract resiliently in two orthogonal directions against a wearer's torso, and engage the torso under the anus of the wearer and provide side-support for proper bra support.

In the embodiments of FIGS. 2 and 6, the breast-feeding openings 210, 212 are located to expose respective portions of the wearer's breasts for nursing an infant while wearing the inner bodice 200. FIGS. 2 and 6 disclose that the shoulder straps 116, 118 of the outer bodice 106 can remain on corresponding shoulders of the wearer, while the outer bodice 106 is pulled up to uncover the openings 210, 212 for nursing an infant through the inner bodice 200. The breast cups 124, 126 are further described with reference to FIG. 1A, and are resiliently deformable to minimize resistance to being pulled up with the outer bodice 106. Advantageously, the nursing garment 100 having the outer bodice 106 can be worn as an undergarment under an outer garment top including, but not limited to a blouse, sweater or jacket that can be pulled up with the outer bodice 106. Thus, the outer garment top can be worn and pulled up while the outer bodice 106 is pulled up in preparation for nursing an infant. The garment 100 avoids a need for removal of the outer garment top or removal of the outer bodice 106 in preparation for nursing an infant.

Further in the embodiments of FIGS. 2 and 6, the fabric of the inner bodice 200 is constructed to provide an inner bra. Further, the inner bodice 200 is fabricated with an elastic reinforced, tubular seamless chest band 704 to extend under the bust of a wearer. Further, the chest band 704 extends circumferentially around the torso of the wearer to provide a bra-like support. The chest band 704 is formed on the inner bodice 200 by turning back a bottom hem 721 of the inner bodice 200 to the inside to form a hollow casing 721*a*. The casing 721*a* is reinforced internally by a stretchable elastic band formed into a hoop encircling the inner bodice 200 to encircle a torso of the wearer. The hollow casing 721*a* is sewn with an anchoring end stitch 721*b* along the edge of the turned back hem 721 to encase the elastic band. The hoop formed by the elastic band is smaller in circumference than the bottom hem 721, such that the hem 721 gathers into multiple pleats 721*c* to gather and shrink the circumference of the bottom hem 721 to the smaller circumference of the hoop formed by the elastic band. The elastic band is stretchable to expand the hoop, and the pleats 721*c* expand or unfold to expand the circumference of the bottom hem 721, for passage of the garment 100 over the head of the wearer while putting on or taking off the garment 100.

Further in the embodiments of FIGS. 2 and 6, the chest band 704 provides elastic support under the wearer's breasts. The chest band 704 and bottom hem 721 drape downward to cover the torso below the wearer's bust. The chest band 704 encircles the garment to encircle the torso of the wearer and to hold the inner bodice 200 securely in place under the bust to provide a bra-like support. Further, the chest band 704 holds the breast-feeding openings 210, 212 in position to expose respective portions of the wearer's breasts The fabric of the inner bodice 200 can be made of a woven or knitted unribbed fabric, or alternatively, the inner bodice 200 is woven or knitted with the ribs of the breast supporting sections 206, 208 encircling respective openings 210, 212. In FIG. 2, the breast supporting sections 206, 208 are separated by a center front section 200*a* of the inner bodice 200 to provide individual breast support. The breast supporting sections are knitted with spandex or elastane fibers knitted into vertical ribs. The ribs are thin or slender, fine ribs. The fabric stretches and contracts resiliently in two orthogonal directions to provide a desirable support for engaging and supporting a wearer's breasts.

With further reference to the embodiments of FIGS. 2 and 6, the fabric of the inner bodice 200 is knitted of a two-way stretchable material, stretchable in two orthogonal directions, suitably soft to the touch and flexible to drape about a wearer's body. According to an embodiment, the inner bodice 200 is seamless and tubular and is circular knitted in one piece with a circumference that completely encircles the nursing garment 100 and the torso of the wearer. The fabric of the inner bodice 200 is knitted of a two-way stretchable material, stretchable in two orthogonal directions, suitably soft to the touch and flexible to drape about a wearer's body. The nursing bra 100 is seamless and has straps 116, 118 without fasteners that require connection and disconnection.

Further in the embodiments of FIGS. 2 and 6, the inner bodice 200 of the nursing undergarment 100 and its chest band 704 are covered by the outer bodice 106 that extends downward to cover the inner bodice 200 and the chest band 704. The outer bodice 106 can be pulled up in preparation for nursing, similarly as described above with reference to FIG. 2. After nursing on the one side is completed, the outer bodice 106 can be pulled down to cover the inner bodice 200 and provide support for the wearer's breasts.

Figure 3:
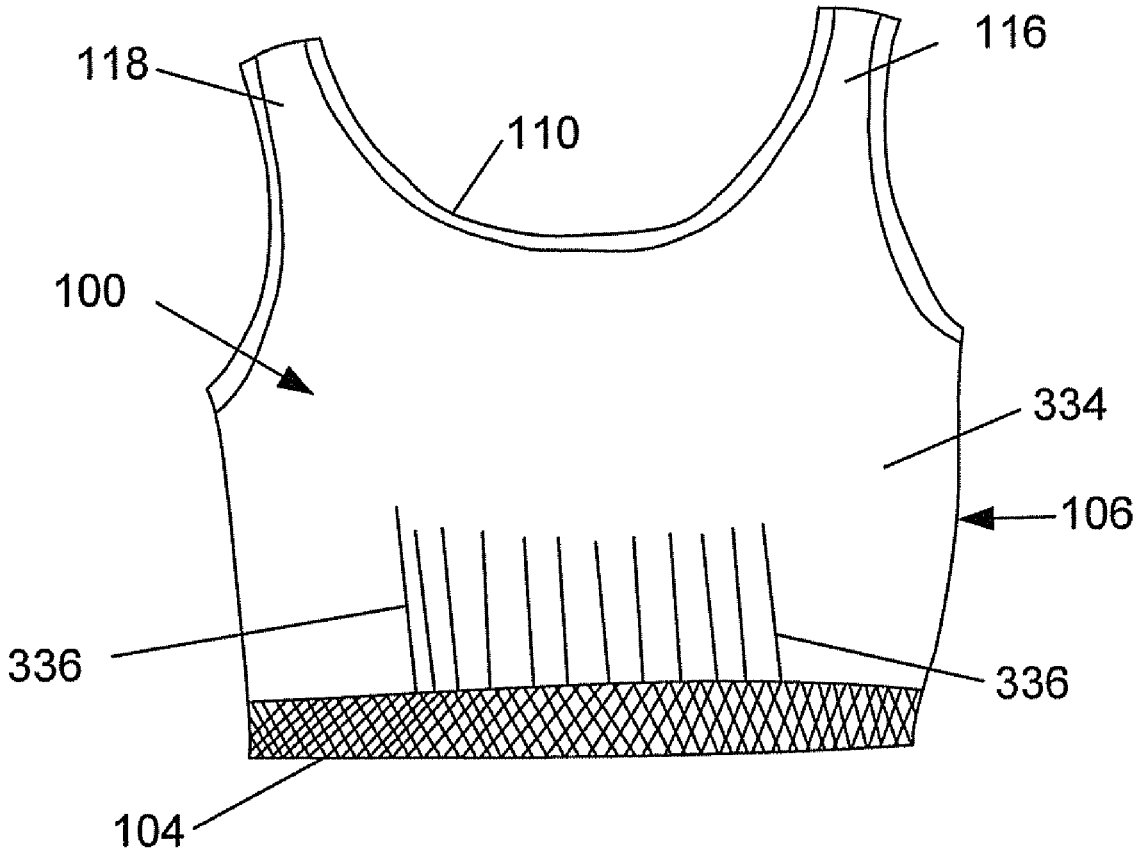
FIG. 3 is an elevation view of a cut and sew nursing undergarment having an outer bodice and an inner bodice covered by the outer bodice.
Figure 5:
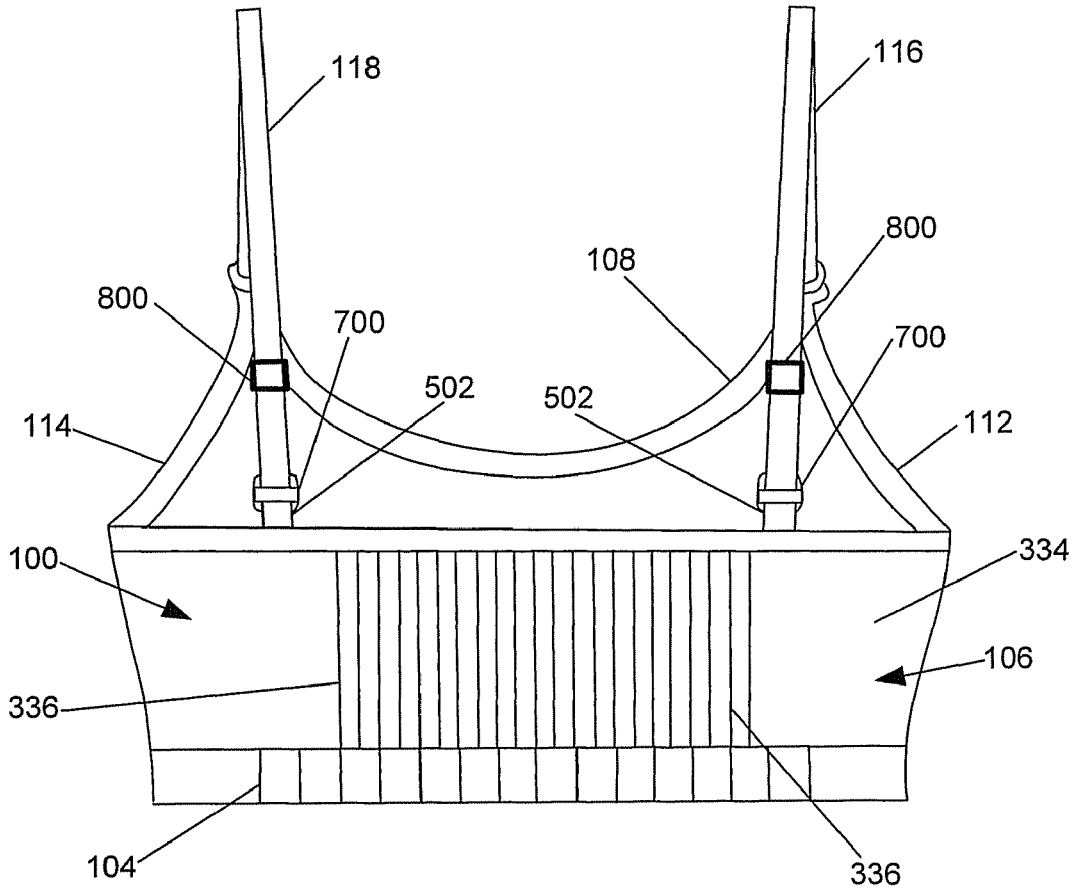
FIG. 5 is an elevation view disclosing a tank back nursing bra construction for the nursing undergarment of FIG. 4.
Figure 5A:
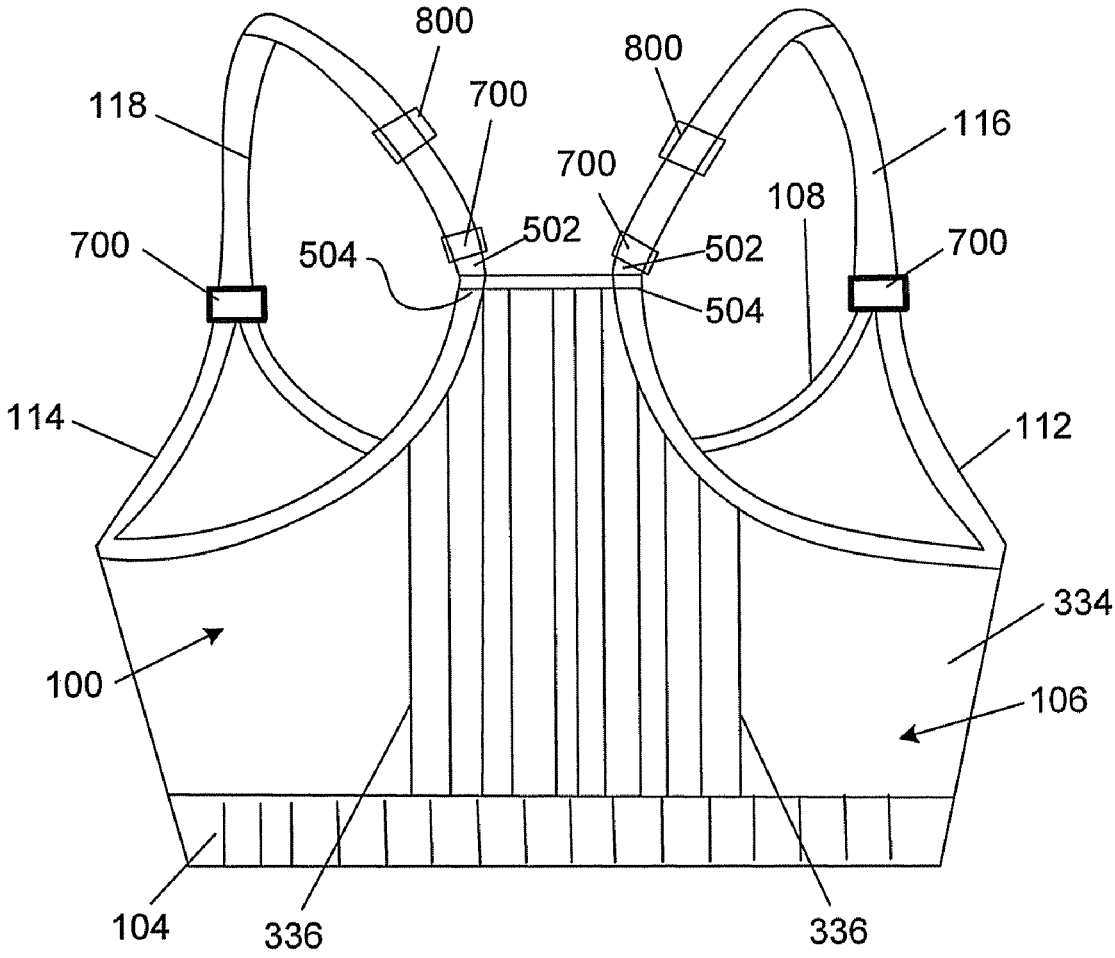
FIG. 5A is an elevation view disclosing a racer back nursing bra construction for the nursing garment of FIG. 4.

FIGS. 3, 5 and 5A disclose different embodiments of the back 334 or back side 334 of the outer bodice 106. In FIGS. 5 and 5A the back 334 or backside 334 is combined with the bodice front disclosed by FIG. 4. The two direction orthogonal elastic stretch of the fabric of the back 334 provides a wearer with bra support and circumferential back support of the wearer. The inner bodice 200 provides a lining in the interior of the outer bodice. The back 334 of the inner bodice 220 merges smoothly with the under arm sections 112, 114, and merges smoothly with the front of the nursing bra 100 to eliminate garment bulges beneath outer clothing. The embodiment of the back 334 in FIG. 3 is constructed to cover essentially a major portion of a wearer's back, and merges smoothly with the back neckline 110 to eliminate garment bulges beneath outer clothing. In FIG. 3 the back 334 or back side 334 extends from the chest band 104 to the back neckline 110, and extends laterally between the under arm sections 112, 114 disclosed by FIG. 1.

In FIG. 5, an embodiment of the outer bodice 106 is constructed as a tank back bra 100. The back 334 is constructed as a tank back 334 in which fabric of the tank back 334 has an upper edge extending across a wearer's back and along a line between low points of arm openings through the under arm sections 112, 114. The tank back 334 and associated chest band 704 extend laterally across the back of a wearer and merge smoothly with the front of the nursing bra 100 to eliminate garment bulges beneath outer clothing.

In FIG. 5A an embodiment of the outer bodice 106 is constructed as a racer back bra 100. The back 334 is constructed as a racer back 334 in which fabric of the racer back 334 extends upward vertically along the spine of a wearer and possesses a limited span between the shoulder blades of a wearer. Two laterally spaced corners 504 on a top edge of the fabric of the racer back 334 are joined to respective bra straps 116, 118. The fabric of the racer back 334 tapers upwardly from the under arm sections 112, 114. The racer back 334 and associated chest band 704 extend laterally across the back of a wearer and merge smoothly with the front of the nursing bra 100 to eliminate garment bulges beneath outer clothing.

In each of FIGS. 3, 5 and 5A a series of vertically extending stitches 336 are spaced apart from each other and are centered at about the center of the back side 334. The stitches 336 extend from about the chest band 104 of the outer bodice 106 and upward along the back side 334. The stitches constrict the back side 304 in a narrowed circumference to conform to the hollow anatomy, or small of the back, of the wearer of the nursing undergarment 100. The stitches 336 can further include stitched pleats, wherein the pleats further constrict the back side 304 in a narrowed circumference. The two direction orthogonal elastic stretch of the fabric of the back side 334 provides a wearer with bra support and circumferential back support of the wearer.

Similarly as described with reference to FIG. 1, each outer bodice 106 in FIGS. 4, 5, 5A and 6 is trimmed with a facing reinforcement or binding to provide an edge trim sewn along the front neckline 108 and along each of the underarm sections 112, 114 and along a back 334 of the nursing bra 100. The facing reinforcement or binding can be of continuous single piece construction. Alternatively, the facing reinforcement or binding can be individual pieces sewn end-on-end.

In FIGS. 4, 5, 5A and 6, the front neckline 108 and the back 334 are attached to spaced apart shoulder straps 116, 118 for extending over respective shoulders of a wearer, to hold the garment 100 in place over the chest. The shoulder straps 116, 118 are sufficiently long for ease in removal from the shoulders of a wearer. In FIG. 4, each of the bra shoulder straps 116, 118 is a flat, knitted stretchable material such as spandex and is fastened to the garment by light-weight flat fasteners 100, 800 of non-staining metal or plastic especially dimensioned and finished for use on lingerie and to lie flat under clothing. More specifically, each bra shoulder strap 116, 118 at the front of the nursing bra 100 is threaded through an eye fastener 100. The eye fastener 100 has a top eye 702 through which the bra shoulder strap 116 or 118 is threaded. The eye fastener 100 has a bottom eye 704 through which is threaded the facing reinforcement or binding at an end of the front neckline 108. For example, the facing reinforcement or binding can be seamless to extend continuously along the front neckline 108, and through each eye fastener 100 at the ends of the front neckline 108. Further the seamless facing reinforcement or binding extends continuously along each of the underarm sections 112, 114 at the ends of the front neckline 108. Alternatively, the facing reinforcement or binding extends through each eye fastener 100 and is cross-stitched to hold each eye fastener 100 in place.

In FIG. 5, at the back of the nursing bra 100, eye fasteners 100 are attached by stem sections 502 of the bra shoulder straps 116, 118 that thread through bottom eyes 704 of the eye fasteners 100 and are sewn to the back 336. In FIG. 5A, at the back of the nursing bra 100, eye fasteners 100 are attached by stem sections 502 of the bra shoulder straps 116, 118 that thread through bottom eyes 704 of the eye fasteners 100 and are sewn to the upper corners 504 of the back 336.

In FIG. 5, each bra shoulder strap 116, 118 is threaded through a corresponding fastener in the form of a slide-adjustable buckle 800. The buckle 800 is slidable along the length of the corresponding shoulder strap 116, 118. Then, each bra strap 116, 118 is threaded though a top eye 702 of an eye fastener 100 attached to the back 336 to provide a loop returning to the buckle 800. An end of each bra strap 116, 118 is sewn to a slender cross-rod 802 through the middle of the slide-adjustable buckle 800. The buckle 800 is slidable along the corresponding shoulder strap 116, 118 to adjust the length of the shoulder strap 116, 118. The shoulder straps 116, 118, buckles 800 and eyes 100 are flat to lie completely flat at the wearer's back and under clothing. The nursing bra 100 is seamless and has adjustable straps 116, 118 without fasteners that require connection and disconnection.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A nursing undergarment, comprising:

an outer bodice and an inner bodice, wherein the outer bodice is adapted for pulling up to uncover the inner bodice and for pulling down to cover the inner bodice, the outer bodice further comprising a center front elastic band to provide breast support; and the inner bodice having openings for breast-feeding and being adapted with curtains for drawing aside at the respective breast-feeding openings.

2. The nursing undergarment of claim 1 wherein a stretchable, torso encircling portion of the outer bodice provides a breast support.

3. The nursing undergarment of claim 1, comprising:

the outer bodice and the inner bodice each having a chest band providing breast support.

4. The nursing undergarment of claim 1 wherein the inner bodice is stretchable to provide breast support.

5. The nursing undergarment of claim 1 wherein the inner bodice has a stretchable chest band and stretchable torso engaging portions providing breast support.

6. The nursing undergarment of claim 1 further comprising breast cups in the outer bodice.

7. The nursing undergarment of claim 1 wherein the outer bodice has pockets receiving respective breast cups.

8. The nursing undergarment of claim 1 wherein the outer bodice has pockets receiving respective breast cups; and the breast cups have an antibacterial agent.

9. The nursing undergarment of claim 1, wherein the outer bodice further comprises adjustable shoulder straps and a tank back.

10. The nursing undergarment of claim 1 wherein the outer bodice has corresponding shoulder straps to hold the inner bodice up while breast-feeding an infant.

11. The nursing undergarment of claim 1 wherein a stretchable, torso encircling portion of the outer bodice provides breast support, and the torso encircling portion is a chest band.

12. A method of using the nursing undergarment of claim 1, further comprising:

pulling up at least on one side of the outer bodice to uncover the breast-feeding openings through the inner bodice in preparation for breast-feeding; and pulling down the outer bodice to cover the inner bodice after completion of breast-feeding.

13. The nursing undergarment of claim 1 wherein the outer bodice has shoulder straps adapted for pulling down.

14. The nursing undergarment of claim 1 wherein the outer bodice has shoulder straps adapted for pulling down, and the inner bodice has corresponding shoulder straps to hold the inner bodice up while breast-feeding an infant.

15. The nursing undergarment of claim 1, further comprising a chest band, wherein the outer bodice joins the inner bodice along the chest band.

16. A method for using the nursing undergarment of claim 1, comprising: pulling up at least on one side of the outer bodice to uncover the breast-feeding openings through the inner bodice in preparation for breast-feeding; and pulling down the outer bodice to cover the inner bodice after completion of breast-feeding.

* * * * *